US009576455B2

(12) United States Patent
Yang et al.

(10) Patent No.: US 9,576,455 B2
(45) Date of Patent: Feb. 21, 2017

(54) CLOUD EAS SYNCHRONIZATION AND FIRMWARE UPDATE

(71) Applicants: Xiao Hui Yang, Saratoga, CA (US); Li Yanshan, Shanghai (CN)

(72) Inventors: Xiao Hui Yang, Saratoga, CA (US); Li Yanshan, Shanghai (CN)

(73) Assignee: WG Security Products, Campbell, CA (US)

( * ) Notice: Subject to any disclaimer, the term of this patent is extended or adjusted under 35 U.S.C. 154(b) by 62 days.

(21) Appl. No.: 14/736,238

(22) Filed: Jun. 10, 2015

(65) Prior Publication Data

US 2015/0356843 A1 Dec. 10, 2015

Related U.S. Application Data

(60) Provisional application No. 62/010,374, filed on Jun. 10, 2014.

(51) Int. Cl.
*G08B 13/14* (2006.01)
*G08B 13/24* (2006.01)
*G08B 29/22* (2006.01)

(52) U.S. Cl.
CPC ..... *G08B 13/2477* (2013.01); *G08B 13/2488* (2013.01); *G08B 29/22* (2013.01)

(58) Field of Classification Search
CPC .. G08B 13/2477; G08B 13/2488; G08B 29/22
USPC ..... 340/568.1, 572.1, 571, 10.1
See application file for complete search history.

(56) References Cited

U.S. PATENT DOCUMENTS 3,071,753 A * 1/1963 Fritze ..... C08B 31/12 340/4.61
5,627,516 A * 5/1997 Balch ..... G08B 13/2471 340/551
5,748,085 A * 5/1998 Davis ..... G08B 13/2474 340/539.1
6,025,780 A * 2/2000 Bowers ..... G06K 19/0701 340/10.51
6,201,469 B1 * 3/2001 Balch ..... G08B 13/2488 340/10.1
7,535,338 B2 * 5/2009 Frederick ..... G08B 13/2488 340/10.1
7,994,911 B2 * 8/2011 Mercier ..... G06Q 30/06 235/375
8,339,264 B2 * 12/2012 Yang ..... G08B 13/246 340/10.1
2006/0097874 A1 * 5/2006 Salesky ..... G08B 13/2417 340/572.1

(Continued)

*Primary Examiner* — Eric M Blount
(74) *Attorney, Agent, or Firm* — Robert R. Waters; Brian W. Foxworthy; Waters Law Group, PLLC

(57) ABSTRACT

A system and method provides access to antennas of an electronic article surveillance system via WiFi and the Internet. Each antenna of the EAS system has a WiFi chip associated with its controls and the WiFi chip relays the antennas operating parameters as well as its reading of electromagnetic noise in its environment to the Internet. A remote technician can review the information provided by the antennas of the EAS system and optimize their operation with each other and their environments. In some embodiments, remote software can optimize the operation of the EAS system antennas. In some embodiments, the WiFi chip is an aftermarket addition.

10 Claims, 9 Drawing Sheets

(56) References Cited

U.S. PATENT DOCUMENTS

| | | | | |
|---|---|---|---|---|
| 2008/0309491 | A1* | 12/2008 | Gillard | G08B 13/2477 340/572.1 |
| 2009/0051534 | A1* | 2/2009 | Aguirre | G08B 13/2488 340/572.1 |

* cited by examiner

CLOUD EAS SYNCHRONIZATION AND FIRMWARE UPDATE

CROSS REFERENCE TO RELATED APPLICATIONS

This application claims priority to U.S. Provisional Application 62/010,374 filed on Jun. 10, 2014. The entirety of U.S. Provisional Application 62/010,374 including both the figures and specification are incorporated herein by reference.

FIELD OF THE INVENTION

The present application is generally related to tuning of electronic article surveillance systems. More particularly, the present application is related to remote tuning of electronic article surveillance systems, and remote updating of firmware electronic article surveillance systems.

BACKGROUND

Theft is frequently a problem in retail stores as well as in other environments. In other environments, it is desirable to track objects. To address these issues, electronic article surveillance (EAS) systems are installed. Generally, in EAS systems, electronic tags, labels, or similarly titled electronic devices are placed on objects to be protected, or monitored. These EAS tags, or devices, are capable of reflecting a signal back to the broader system. The broader EAS system creates interrogation fields which energized the EAS tags to produce the signals that the tag and the object to which it is attached are in the interrogation fields.

These interrogation fields are frequently set up at exits or entries to an area that is being monitored or protected. Frequently, the antennas that are used to generate the interrogation fields and to monitor for tag signals are housed within pedestals that are placed to each side of an exit. However, these antennas and their controlling electronics can be positioned overhead or within the floor in the area close to the exit.

The controlling electronics for these antennas generate a signal which is transmitted by the antennas and creates the interrogation field. This field energizes or stimulates tags that are passing through the interrogation field, or zone. The tags then produce a signal in response to the interrogation field. This signal from the tags may be created by energy of the field itself, or the tags may have on board power supplies and electronics that reply to the interrogation field. The interrogation field is cycled for periods of transmission and monitoring. The interrogation field initially cycles and broadcast out into the zone being monitored and then the interrogation field is stopped. The antennas of the EAS system then monitor for a tag signal. If a tag signal is detected, it assumed that the tag is improperly in the zone being monitored by the interrogation field, and the EAS system determines that an alarm condition is in effect. The EAS system can then generate an alarm, either an optical alarm such as flashing lights, an audible alarm such as bells, etc., or a system alarm that is broadcast to operator stations.

The signals from the electronic EAS tags are relatively week and it is common to have electro-magnetic noise within the area being monitored by the EAS system. This electro-magnetic noise may the result of other EAS systems in proximity to the system monitoring a given area, or the noise may be a product of other systems such as lighting, motors, etc. When the noise is sufficiently loud, it can mask the presence of an EAS tag during the monitor phase of the EAS cycle, or alternatively, it may produce a false positive when a tag is not actually there. In many cases, a false positive is considered to be worse than missing a tag that is present as it may indicate, falsely, that somebody is attempting to remove an article.

If the noise is the product of another EAS system, then it will have a cyclic profile, similar to the one monitoring a given area. Such a case may occur for retail locations that are located within a mall, for example. In the case of a mall, there are several EAS systems operating in relatively close proximity to each other, each of which will be transmitting interrogation fields and then monitoring for responses.

A given retail outlet will have no control over the EAS system of a neighboring retail outlets electronic article surveillance system. If a neighboring system is cycling at similar rates but at different times, then it will be transmitting an interrogation field while the "home" EAS system is monitoring for tags within its interrogation field or zone. Since the signal of the EAS tags are relatively week, the transmission of a neighboring EAS system may very well appear to be a tag and cause an alarm condition for the home EAS system. Even if the noise source is not another EAS system, it will most typically still have a cyclic profile. Which is to say, the noise source will have periods where it is stronger, and periods where it is weaker.

To combat the effects of noise in an environment, the profile of the noise in an environment can be captured, or recorded, and analyzed. The EAS system experiencing the noise problem can then be tuned to decrease the effect of the noise in the environment. In cases where the noise is the result of neighboring EAS systems, the home EAS system can be tuned to the neighboring EAS system. In this case, the home EAS system is tuned to transmit its interrogation field in synch with the neighboring system so that they are transmitting their interrogation fields at the same times and monitoring for tags at the same times. This gives the home EAS system a quieter time to monitor for tags, since the neighboring system is also at rest and listening for tags. In other cases, rather than tuning the home EAS system to transmit during the peak of environmental electromagnetic noise, such as when a neighboring EAS system is transmitting, the home EAS system is tuned to time its cycle to be in the lull of a noise profile so that it transmits it interrogation field and also monitors for a response at a minimum point in the noise profile in that environment.

Additionally, electronic article surveillance systems use digital signal processors DSPs and other components in their controls. These components are programmable at various levels and upgrades to their programming and firmware are sometimes required. In older, relevant art systems, this upgrade to the programming and firmware is performed by a technician actually going to the site of the EAS system to upgrade the firmware and sometimes to change out components and circuit boards.

SUMMARY OF EMBODIMENTS OF THE INVENTION

Embodiments of the present invention employ EAS system controls having WiFi capabilities. The EAS system controls have the capabilities to operate the antennas of the EAS systems to generate interrogation fields and monitor for reply signals. The WiFi capabilities provide the capability to connect to the Internet and to utilize Cloud computing capabilities. Information about the current and historical operating status of a system can be uploaded to the Internet, along with readings of the environment in which the system is operating. The system can upload information on the timing of its cycles for each of its antennas, the number and frequency of alarms, the location of alarms, and other parameters of the system. Each antenna of the system can also function as an oscilloscope to measure ambient electromagnetic fields in its vicinity. This information can also be uploaded to the Internet for analysis and diagnosis.

Upon analysis and diagnosis of the EAS system and its environments, the system can be tuned for optimal performance. Instructions can be transmitted to the system to adjust the timing at each of the antennas in the system. Depending on the electronic noises in the environment at a given antenna, the cycles of that antenna can be adjusted to optimize its operation within the environment. If noise is primarily caused by a neighboring EAS system, the home EAS antenna can be set to broadcast and monitor in coordination with the neighboring EAS system. If the environment has a combination of noise sources, the EAS system can be tuned so that the monitoring portion of its EAS cycle occurs during a low point in the noise profile.

In addition to tuning adjustments, more substantial changes can be made to the controllers for the antennas. The firmware for digital signal processors and other components can be upgraded via the WiFi connection. This allows the upgrades to be made without the onsite presence of a technician. This reduces costs, and improves timeliness of upgrades.

BRIEF DESCRIPTION OF DRAWINGS

Additional utility and features of the invention will become more fully apparent to those skilled in the art by reference to the following drawings, which illustrate some of the primary features of preferred embodiments.

DETAILED DESCRIPTION OF EMBODIMENTS OF THE INVENTION

Generally, in EAS systems, electronic tags, labels, or similarly titled electronic devices are placed on objects to be protected, or monitored. Protected, or monitored, objects are detected or monitored via these electronic monitoring devices by the larger EAS system and its antennas. One way to categorize these monitoring devices is active versus passive. If the electronic monitoring device is passive it relies on obtaining energy from its environment to produce a signal or perform other limited activities. If it is an active electronic monitoring device, it has its own power source and typically has more capabilities.

EAS systems transmit signals, or fields, into monitored areas to detect and communicate with tags in the monitored areas. These signals or fields are frequently call interrogation fields. The fields are transmitted in bursts and the EAS systems monitor between bursts, with antennas, for responding signals from monitoring devices in the monitored space. If the monitoring device, or tag, is a passive device, it will rely on the field transmitted by the antennas to acquire energy for a reply signal. If it is an active device, it will have its own power supply for its electronics to generate a signal. With either type of monitoring device, the reply signal will be relatively weak, especially in an electrically active environment with sources of electronic signal noise. These factors require optimized location and configuration of antennas, optimized timing of bursts and pauses between bursts, and the ability to tune the EAS system, including tuning the timing of the cycles of system signals.

Figure 1:
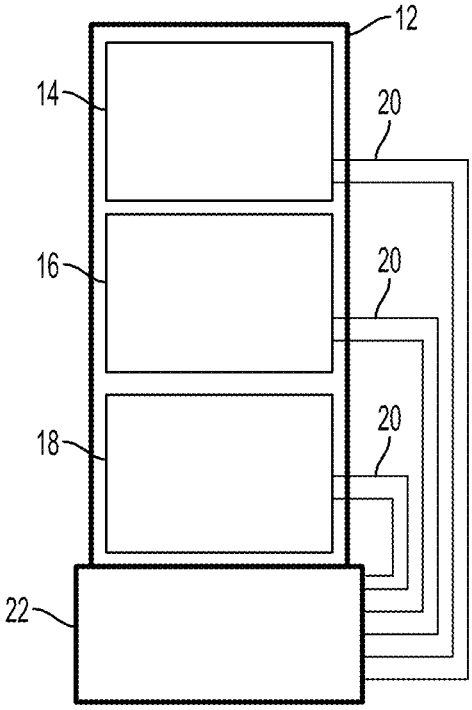
FIG. 1 is a front view of a pedestal mounted set of EAS antennas.

FIG. 1 is a front view of a pedestal mounted set of antennas of an EAS system. In FIG. 1, antenna pedestal 12 has three antennas 14, 16, and 18 with wires 20 running from base 22 of pedestal 12 to control antennas 14, 16, 18. Although antenna pedestal 12 of FIG. 1 has three antennas, this is not a requirement and is only a representation of an embodiment of an antenna operated in an embodiment of the present invention. Depending on the embodiment, each antenna in an antenna pedestal, such as antenna pedestal 12, can operate as a transmitting antenna, receiving antenna, or a transceiver antenna. The particular application of the system and the algorithms being used will determine the particular configuration of antennas and how the controls in base 22 operate the antennas.

Figure 2:
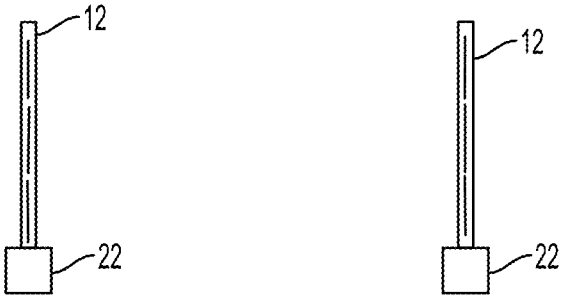
FIG. 2 shows a pair of EAS antenna pedestal of the type shown in FIG. 1 in position to create an interrogation zone for a controlled area such as at an exit from a retail location.
Figure 3:
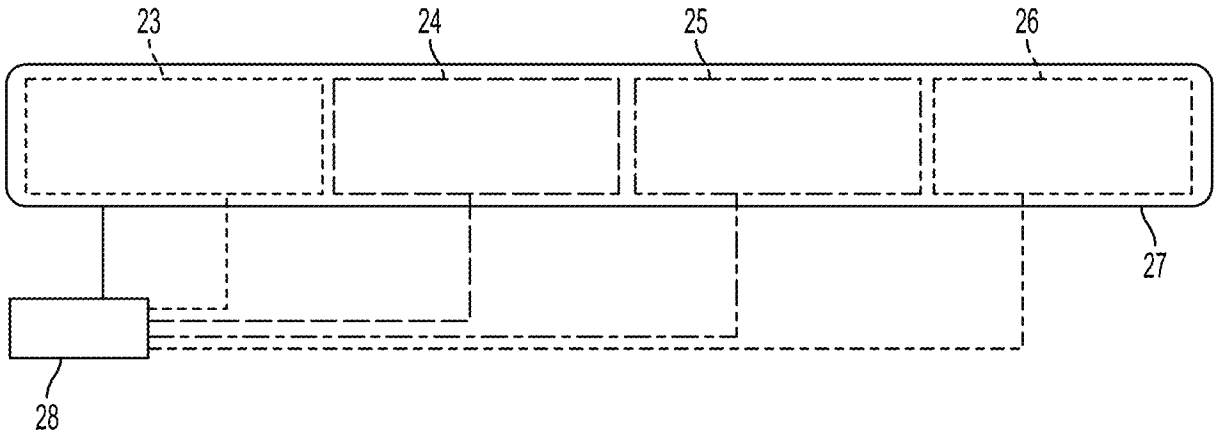
FIG. 3 shows a set of EAS antennas configured to be installed horizontally, such as in the floor of a monitored area.

FIG. 2 shows a pair of EAS antenna pedestals 12 of the type shown in FIG. 1 in position to create an interrogation zone for a controlled area such as at an exit from a retail location. The antenna pedestals 12 of FIG. 2 may be controlled by their own controls or they may be controlled by a single set of controls. These controls may be located in bases 22 of antenna pedestals 22. FIG. 3 shows a set of EAS antennas configured to be installed horizontally, such as in the floor of a monitored area. In the embodiment of EAS antennas of FIG. 3, four interior loop antennas 23, 24, 25, and 26, are located within a larger exterior loop antenna 27. Each different type of line in FIG. 3 representing a separate and distinct antenna. Although FIG. 3 shows each antenna's feed connecting to control box 28, each antenna may be driven by different control boards within control box 28, or each antenna's feed may connect to different control boxes with different control boards.

Figure 4:
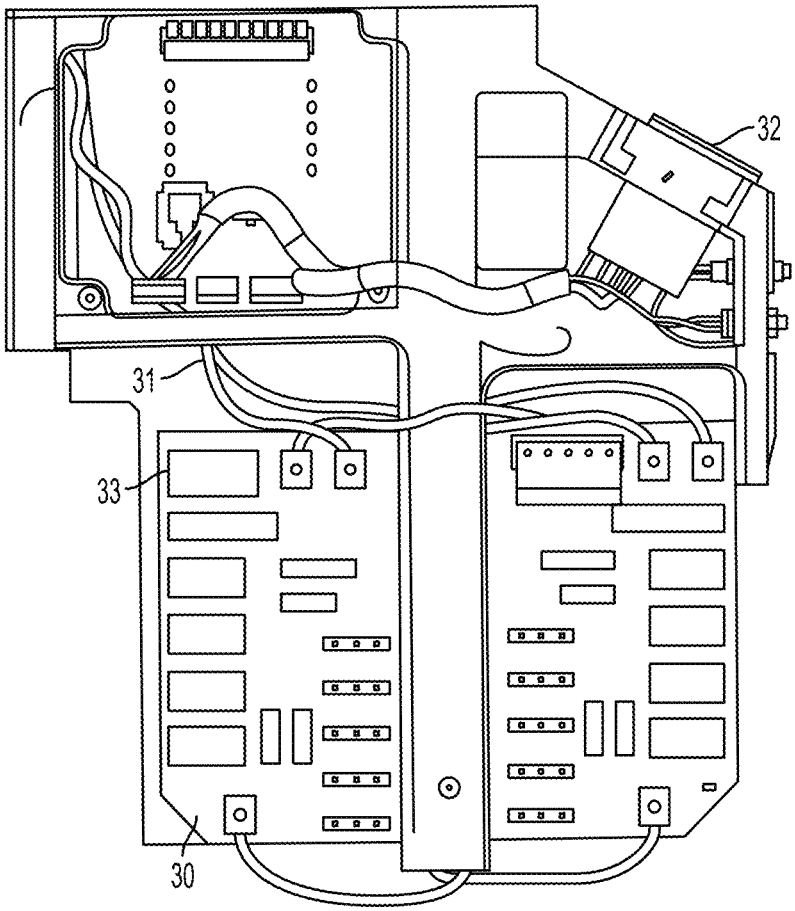
FIG. 4 shows controller circuit board for EAS antennas.

FIG. 4 shows controller circuit board 30 for EAS antennas. Circuit board 30 operates an EAS antenna of the EAS system through wires 31 to generate interrogation fields and monitor for reply signals. For acousto-magnetic (AM) tags, i.e. monitoring devices, the interrogation fields are generated in bursts and then the field is ceased so that the system can monitor for reply signals from AM tags without the interrogation field causing interference. This alternation between broadcast and monitoring occurs in rapid succession and the timing between broadcast and monitor is crucial. The pause in broadcast of the interrogation field must be long enough for the field to ring down in the environment so that the signals of AM tags present in the monitored zone can be detected. When multiple antennas are operating within a single system, the antennas must be synchronized. This is especially so when the antennas are in proximity to each other. If the antennas are not synchronized, a first antenna's interrogation signal may be detected by second antenna and then the second antenna interpret the interrogation signal of the first antenna as a reply signal from a tag within the second antenna's interrogation zone.

Figure 5:
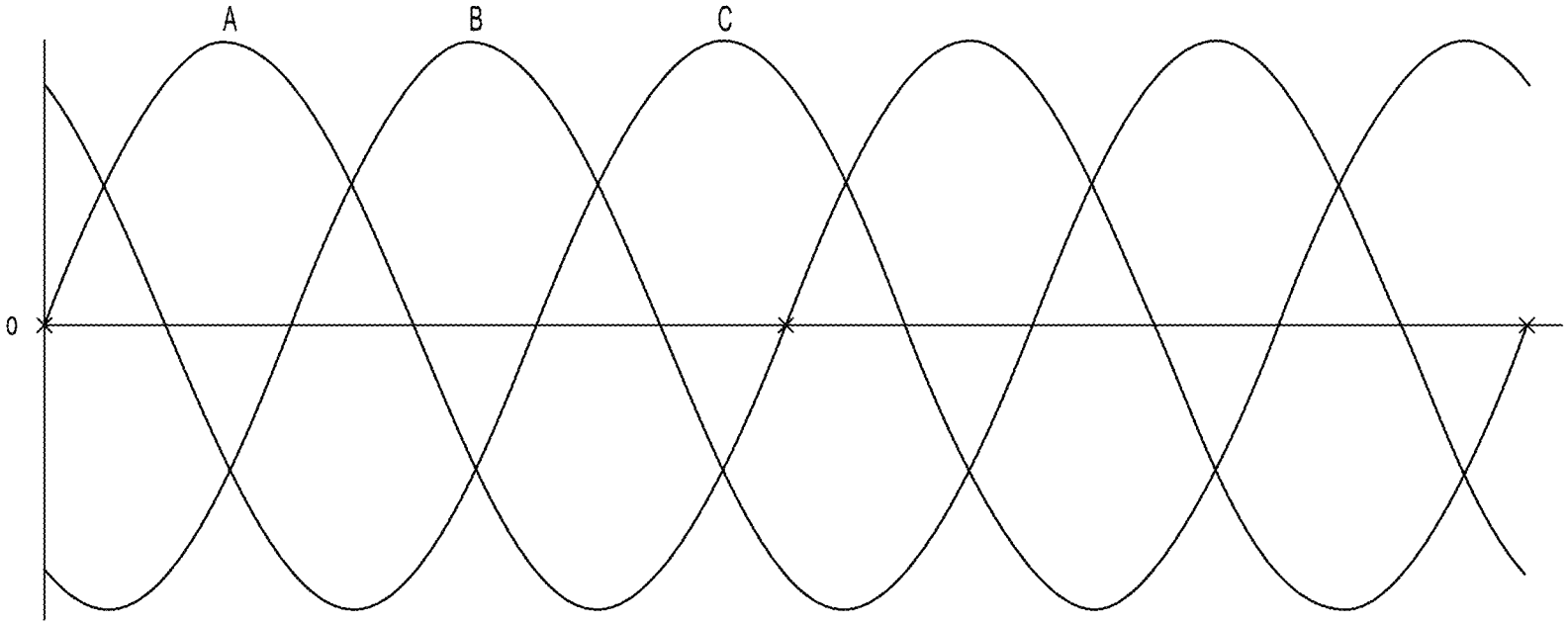
FIG. 5 shows the sine wave pattern of typical three phase power.

To synchronize antennas operating within the same EAS system but operated by different controller circuit boards 30, it is helpful to have a common timing reference. FIG. 5 shows the sine wave pattern of typical three phase power where there is a difference of 120° phase difference between the phases. In FIG. 5, the zero crossings of one of the phases, labeled A, is marked. The controllers of separate antennas can use the zero crossing points of the same phase of a three phase power supply as a reference point to synchronize their field bursts and pauses between the bursts. The common power systems operate at 60 Hz (United States) and 50 Hz (Europe). While those are the frequencies of the power system, that is not necessarily the frequency of the timing of the bursts. An interrogation field burst may be transmitted more than once within a single cycle of a phase of the power source, or the period between bursts could exceed that of the period of a phase of the power source.

Figure 6:
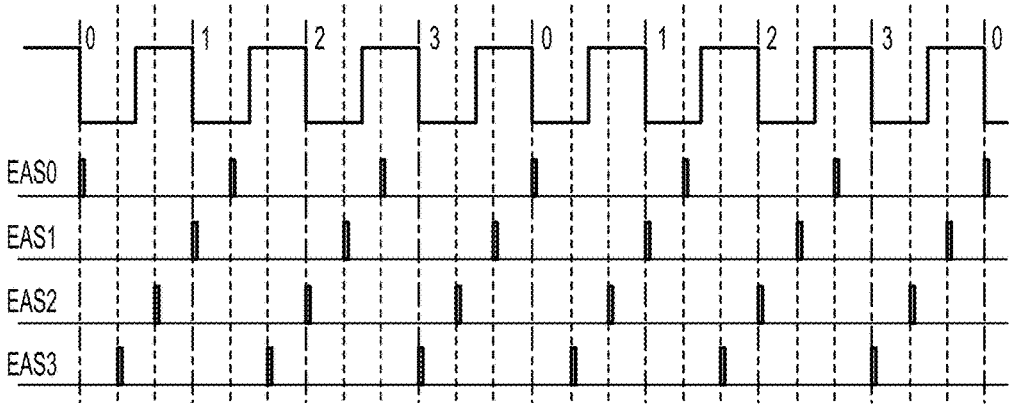
FIG. 6 is a graph of the bursts of EAS antennas that are synchronized, juxtaposed beneath a square wave indicating zero crossings of a phase of AC power.

FIG. 6 is a graph of the bursts of EAS antennas that are in synch, juxtaposed beneath a square wave indicating zero crossings of a phase of AC power. Although the bursts do not occur simultaneously, they are considered to be synchronized because there is adequate time between each antenna's burst transmission to prevent interference with other antennas. For example, if an antenna's burst transmission has a duration of 1.6 ms and a minimum interval of 6.66667 ms (60 Hz system) or 5.55556 (50 Hz system) between it and other antenna burst transmissions there will be no interference by that antenna with other antennas.

Figure 7:
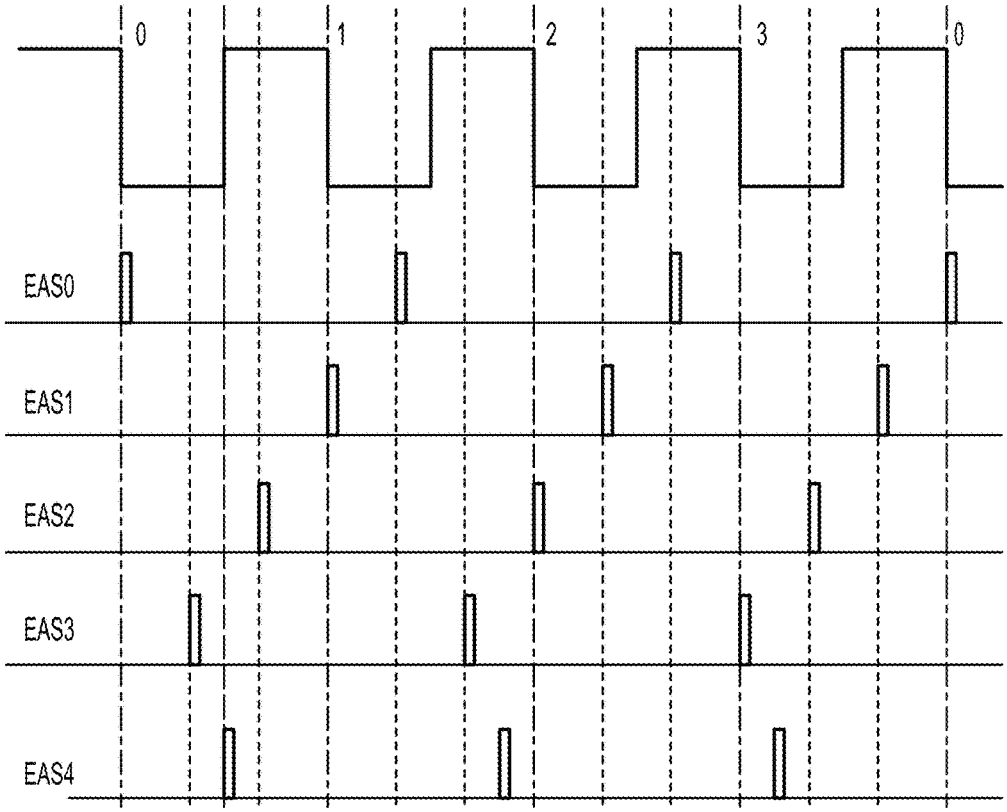
FIG. 7 is a graph of the bursts of EAS antennas that are not fully synchronized, juxtaposed beneath a square wave indicating zero crossings of a phase of AC power.
Figure 8:
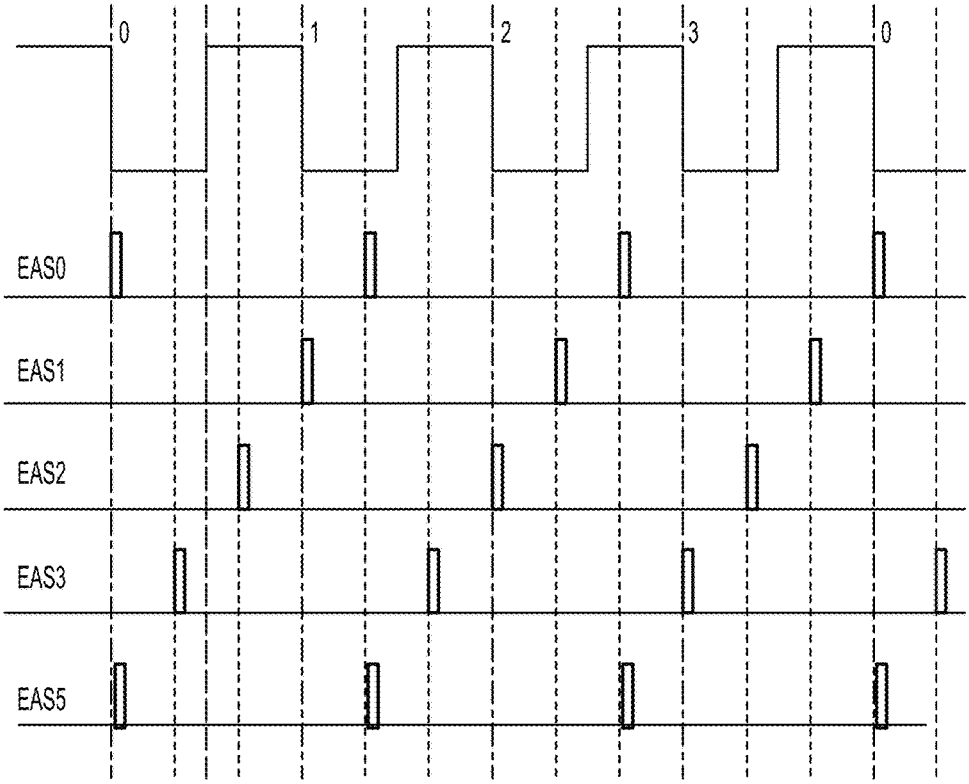
FIG. 8 is a graph of the bursts of EAS antennas that are not fully synchronized, juxtaposed beneath a square wave indicating zero crossings of a phase of AC power.

FIGS. 7 and 8 are graphs of the bursts of EAS antennas that are not fully synchronized, juxtaposed beneath a square wave indicating zero crossings of a phase of AC power. In FIG. 7, the burst emitted by the antenna EAS4 is initiated halfway between the bursts of EAS3 and EAS2. In this scenario, the burst of EAS4 may interfere with the monitor phase of the operation of EAS3, while the burst of EAS2 may interfere with the monitor phase of operation of EAS4. In FIG. 8, the burst of EAS5 initiates while the burst of EAS0 is still transmitting. In this case, the burst of EAS4 may linger into the monitor time period of EAS0 and interfere with the monitoring phase of operation of EAS0.

To solve the situations depicted in FIGS. 7 and 8, the EAS antennas need to be tuned with each other. Returning to FIG. 4, circuit board 30 has plug 32 for coupling with external analytical tools. In prior art systems, a technician actually on site at the EAS system connects analytical tools to plug 32 of circuit board 30 to analyze the operating state of an antenna. By connecting to circuit board 30 of an EAS antenna, a technician can determine when that antenna is transmitting its bursts in relation to the zero crossing of the reference phase of the AC power supply. The technician can also capture and analyze the spectrum of electro-magnetic signals received by that antenna. However, the technician can only acquire information from a given antenna from that antenna's perspective.

The information in FIGS. 6, 7, and 8 presented within those individual single figures cannot be gathered from a single antenna. Rather, FIGS. 6, 7, and 8 represent information painstakingly gathered by a technician connecting to each of the respective EAS circuit boards driving the antennas (EAS0, EAS1, etc.) represented in those figures. Typically, these circuit boards are remote from each other, such as when antennas are set up at different exits from retail areas, etc. This means that in prior art systems, a technician must analyze and record results after taking readings from the antenna controller circuit boards that are accessible to the technician, before the process of diagnosing the appropriate corrective action can begin.

Once the appropriate corrective action is determined, the technician returns to the antenna controller where the corrective action is to be taken. For example, in the situation depicted in FIG. 7, the technician may advance the burst of EAS4 to coincide with EAS3, or the burst of EAS4 may be delayed to coincide with that of EAS2. As another example, for the situation depicted in FIG. 8, the burst of EAS5, would probably be advanced to coincide with EAS0. A further example, not depicted in the figures may be discussed with reference to FIG. 6. If, after taking readings at each of the antennas represented in FIG. 6, a technician determines that the bursts of one of the antennas has drifted in its timing to cause the problem shown in FIG. 7 or FIG. 8, the technician could adjust the timing of the offending burst to coincide with an open "space" in the time domain. After the adjustment, FIG. 6 would represent each EAS antenna operating in its own time slot. Referring to FIG. 8, it can be seen that if enough antennas are operated in proximity with each other, it will be necessary for some of those antennas to transmit at the same time in order for those antennas not to interfere with each other.

It should be noted at this point that the previous discussion had as one of its assumptions, that the diagnosing technician has access to all of the EAS antennas which have signals detectable in a given area. This is frequently not the case. For example, in a retail store located within a retail mall, or shopping center, a technician troubleshooting for that retail store will only have access to the EAS antennas of that retail store. Neighboring retail stores will most likely have EAS systems operating at the same radio frequency, but the timing of the interrogation field bursts transmitted in the neighboring stores will not necessarily synchronize with those of the "home" store where the technician is working. The technician must optimize the EAS system of the home store without recourse to making changes to neighboring EAS systems. Further, many EAS system antennas will receive radio frequency signals that don't have anything to do with electronic article surveillance and are just noise. For example, fluorescent lighting can in some situations produce noise at a sufficient level and at a frequency close enough to the operation frequency of AM systems to effect the functioning of an EAS antenna. A technician must optimize the EAS system while having no control over extraneous sources of noise.

Returning to FIG. 4, circuit board 30 has WiFi chip 33. WiFi chip 33 can access a detected WiFi hotspot like any WiFi chip. Upon access to the Internet via WiFi chip 33 and a WiFi hotspot, circuit board 30 can be interrogated from a Cloud location. In situations where more than one EAS antenna controller is present at a location, each controller circuit board 30 will have access to the Internet and the Cloud, and the information shown in FIGS. 6, 7, and 8 can be readily obtained, remotely. Further, in addition to each controller circuit board 30 reporting its own interrogation field burst timing, each controller circuit board 30 can report radio frequency signals it is receiving at its location. This effectively makes each EAS antenna an oscilloscope for its particular location.

Figure 9:
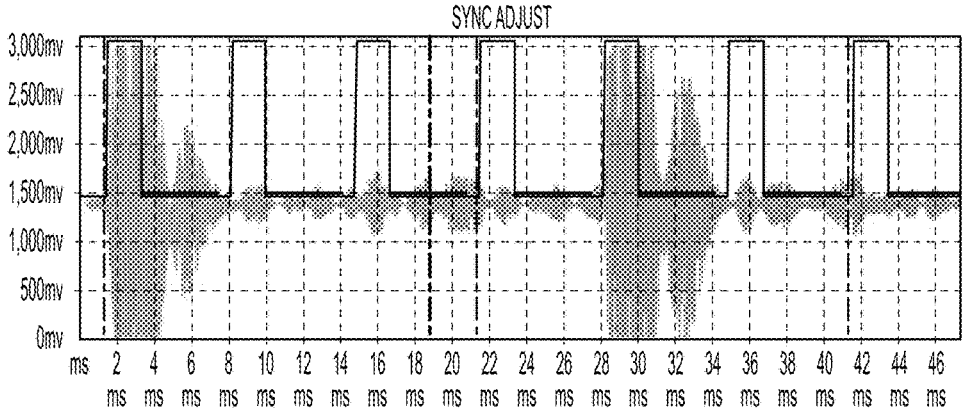
FIG. 9 shows a signal display of a reference EAS device.
Figure 10:
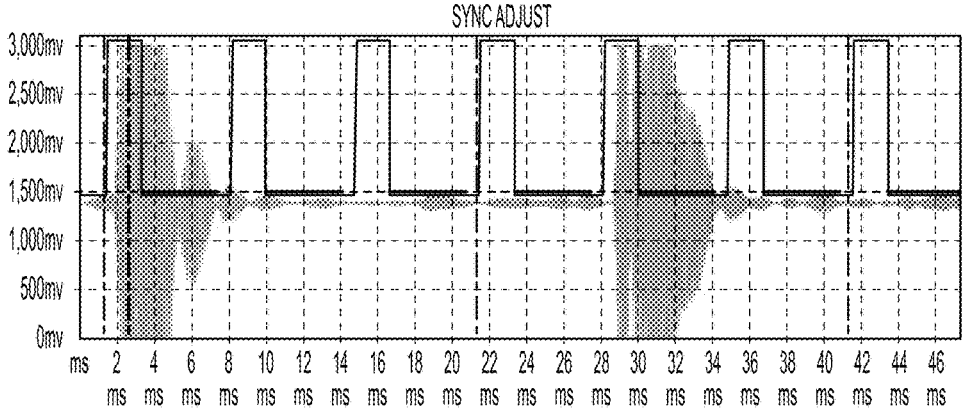
FIG. 10 shows an EAS device out of sync with the reference EAS device of FIG. 9.
Figure 11:
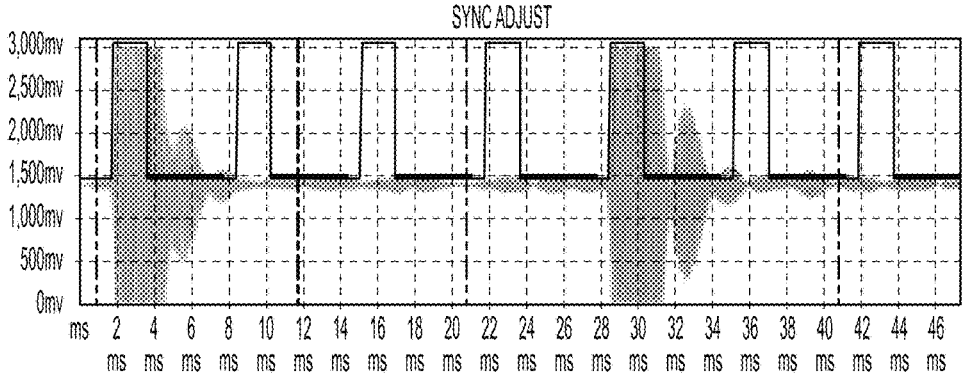
FIG. 11 shows the results of synchronizing the EAS device of FIG. 10 with the EAS device of FIG. 9 via the WiFi connection through the Cloud.

FIG. 9 shows a signal display of a reference EAS device. FIG. 10 shows an EAS device out of sync with the reference EAS device of FIG. 9. FIG. 11 shows the results of synchronizing the EAS device of FIG. 10 with the EAS device of FIG. 9 via the WiFi connection through the Cloud. The operation of the device of FIG. 10 has been advanced to coincide with the operation of the device of FIG. 9.

In the previous example, the correction was to advance the operation of the antenna. In other environments, the adjustment may be different. For example, antennas within the same EAS system (retail location) may have drastically different local environments. Some antennas may be able to be synchronized to transmit their interrogation bursts at the same time, while another is in an environment affected by EAS systems in neighboring retail stores. That antenna may have its timing adjusted to transmit in a "space" where noise from the neighboring system is at a minimum. The ability to analyze the signal spectrum experienced at each location allows faster and finer tuning across the system from a remote location without the need of an onsite technician.

Contact between local EAS devices and the Cloud may occur in several modes. In one embodiment of the system, the local EAS devices have continuous access to a WiFi hotspot and the Cloud has continuous access to the components of the EAS system. In that embodiment of the system, the Cloud can continuously monitor the system to make sure it operates within tolerance envelopes. If anomalies are detected, the software on the Cloud servers can adjust the operation of the appropriate component of the EAS system to bring the system into tolerance. The Cloud servers can also capture desired system information such as alarm frequency, antenna location of alarms, number of alarms, ambient noise profiles, etc. This information can be produced in reports for a client, etc.

In another embodiment of the system, the EAS system can operate statically as initially set up. When an issue is detected by local operators, a temporary WiFi hotspot can be introduced to the location of the EAS system. With the connection to the Cloud established, diagnostics of the EAS system can be executed at that time and adjustments made. Information stored locally can be accessed and extracted for presentation to the local administrator of the system.

Figure 12:
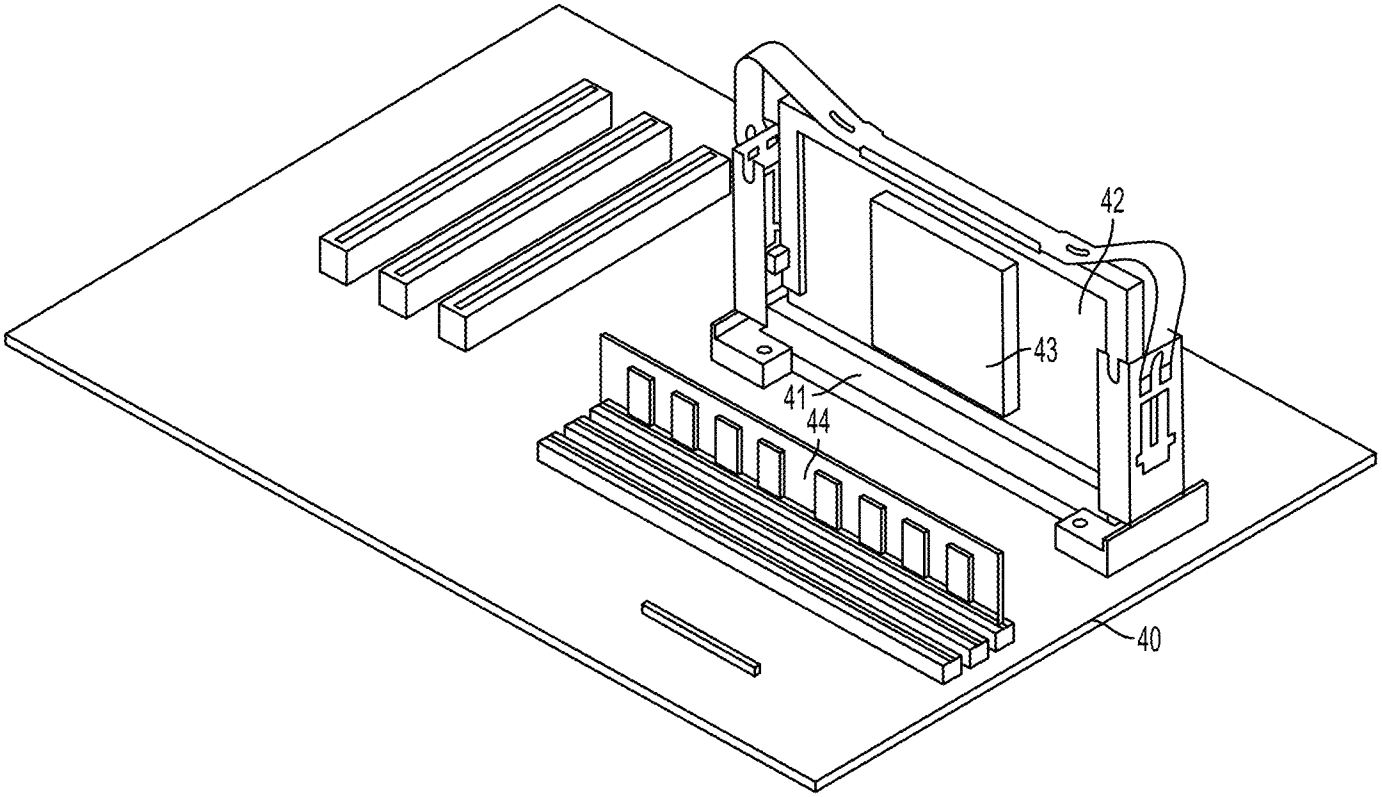
FIG. 12 shows a WiFi chip mounted on a card for adding to a circuit board.

In FIG. 4, WiFi chip 33 is mounted directly on controller circuit board 33. FIG. 12 shows WiFi chip 43 mounted on card 42 for adding to a circuit board. Circuit board 40 has socket 41 for receiving card 42. Circuit board 40 has additional chips 44 for increased capability supporting WiFi chip 43. In order to add the WiFi element to an EAS controller already operating in location, circuit board 40 is itself mounted as a secondary circuit board onto a controller circuit board for an EAS antenna such as controller circuit board 30. In other embodiments, card 42 and WiFi chip 43 are added directly to a socket on an antenna controller circuit board such as circuit board 30 to add the WiFi element.

In addition to occasional tuning adjustments, EAS controllers may need firmware updates. In prior art systems, a technician must go to the location of the EAS system and upgrade the firmware for the digital signal processor (DSP) and other components. In some cases, entire controller boards may be replaced. Replacing the whole board may require a lower level of skill, but it is still an expensive visit from a technician which depends on scheduling etc. Embodiments of the present system do not require a technician to go to the EAS system site. Rather, the WiFi connection capabilities of embodiments of the present system allow firmware updates for an EAS controller to also be done from a distance over the Cloud. This decreases the expense and increases the speed and convenience of the firmware update.

Figure 13:
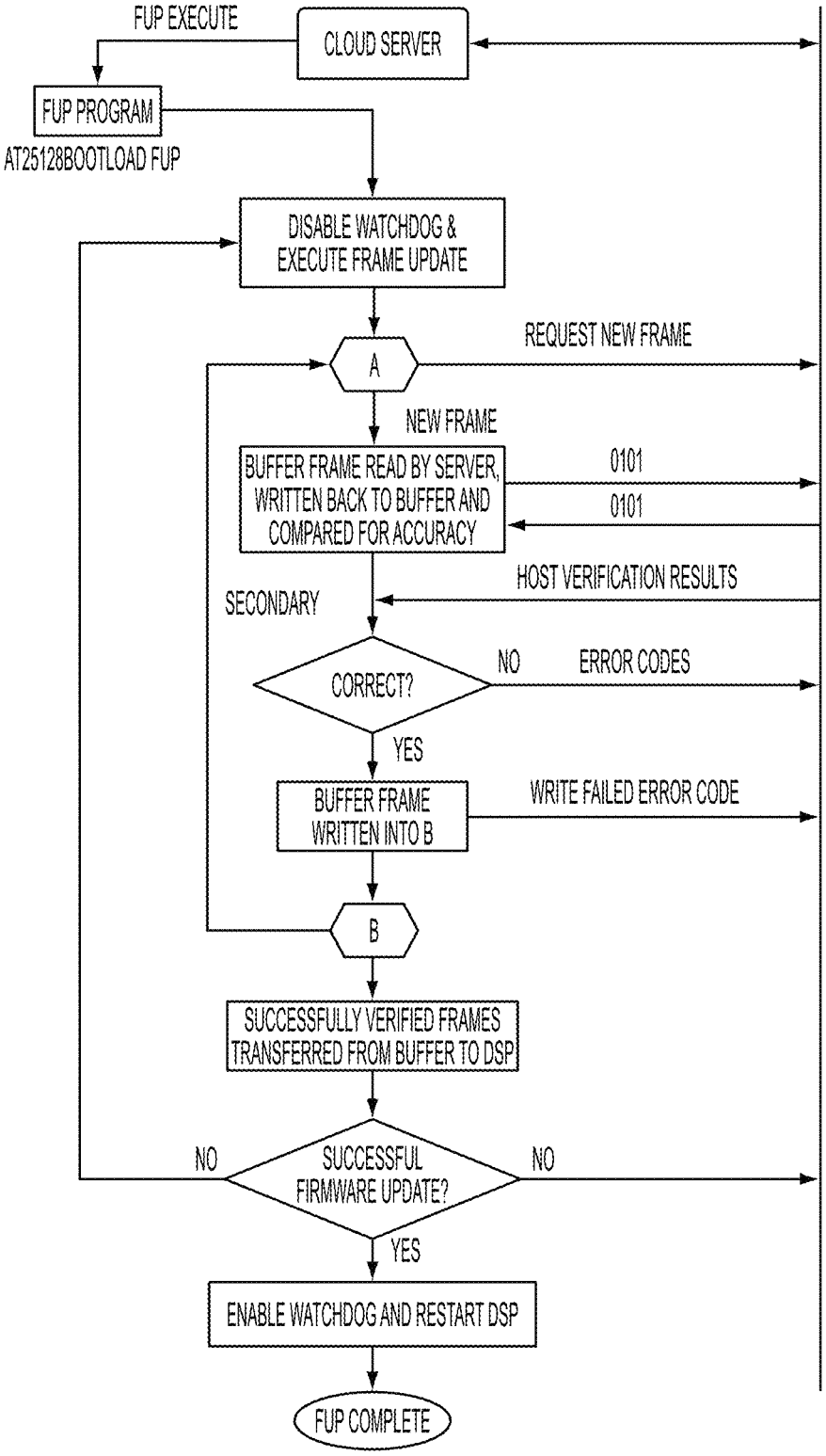
FIG. 13 is a flow chart of a firmware update for an EAS controller executed through the Cloud.

FIG. 13 is a flow chart of a firmware update for an EAS controller executed through the Cloud. When the DSP device needs to be upgraded, the terminal PC link software will command the controller to reset the DSP and start the Boot Loader. After the Boot Loader command, the software will issue a DSP firmware update (FUP) request and disable the Watchdog. The Watchdog monitors the controller and resets it if the controller is inactive too long and appears to be hung up. If the Watchdog is not disabled, it may reset during the update process. Once the Watchdog is disabled, existing firmware will be erased and new firmware will be downloaded in frames into flash cache memory until the entire firmware is downloaded. As each frame is written, the data will be read back through the cloud and its integrity verified. Once the code is completely verified, the DSP will be programmed with the new firmware and verified once more. When the new firmware is successfully verified, the Watchdog will be enabled and a reset is issued to the DSP. At this point the DSP will start running with the updated firmware.

It is possible that, on occasion, an attempt to update the firmware of the digital signal processor and other elements will fail. As part of the update process, steps are taking to mitigate such an event. Before the new firmware is transferred from the buffer, the existing firmware operating in the controller is copied to the cloud host. If the firmware update fails to run on the controller, the previous version of firmware can be downloaded from the cloud host and reloaded into the controller. This ensures that a controller is not left disabled due to a failed upgrade. The pre-existing firmware can be copied to the cloud host at the beginning of the update process, or it can be copied before the newer firmware is transferred from the buffer to the operating memory of the DSP and other elements.

It is to be understood that the embodiments and claims are not limited in application to the details of construction and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

We claim:

1. A tunable EAS system, comprising:

at least one antenna;

a controller circuit board for each said antenna, each controller circuit board having WiFi capabilities allowing each said controller circuit board to wirelessly connect to the same central computer, each said controller circuit board comprising a controller executing machine readable instructions, each said controller circuit board being powered by alternating current;

each said controller circuit board operating its respective antenna as a transmitting antenna to generate an interrogation field and as a receiving antenna to detect the ambient electromagnetic noise profile for its antenna and to detect EAS tags in its interrogation field;

each said controller circuit board transmitting its own interrogation field cycle, the ambient electromagnetic noise profile detected by its respective antenna, and the zero crossing reference for its AC power supply to the central computer;

each said controller circuit board being tunable from the central computer for optimized performance in its ambient electromagnetic noise profile and with all other EAS antennas in the tunable EAS system.

2. The tunable EAS system of claim 1, wherein:

the central computer is an Internet server and each said controller circuit board transmits to the Internet server via a WiFi hotspot.

3. The tunable EAS system of claim 2, wherein:

the WiFi hotspot is a permanent hotspot providing continuous real time connection to the Internet and the Internet server is a Cloud server executing automated machine readable instructions to keep the EAS system in optimal performance.

4. The tunable EAS system of claim 1, wherein:

said WiFi capabilities are provided by a WiFi chip mounted directly to each said controller circuit board.

5. The tunable EAS system of claim 1, wherein:

each said controller circuit board comprises at least one card socket and said WiFi capabilities are provided by a WiFi chip mounted on a card inserted into said card socket.

6. The tunable EAS system of claim 1, wherein:

at least one of said antennas comprises a transceiver coil.

7. The tunable EAS system of claim 1, wherein:

at least one of said antennas comprises a transmitter coil and a receiver coil.

8. The tunable EAS system of claim 1, wherein;

said machine readable instructions comprise firmware.

9. The tunable EAS system of claim 8, wherein;

said firmware is updatable from the central computer.

10. The tunable EAS system of claim 9, wherein;

said controller circuit board comprises a buffer in flash cache memory for storing a full copy of new firmware locally before the firmware is updated.

* * * * *